US009540195B2

(12) United States Patent
Yamagishi

(10) Patent No.: US 9,540,195 B2
(45) Date of Patent: Jan. 10, 2017

(54) SHEET CONVEYING DEVICE, AND IMAGE FORMING APPARATUS INCLUDING THE SHEET CONVEYING DEVICE

(71) Applicant: KYOCERA Document Solutions Inc., Osaka-shi, Osaka (JP)

(72) Inventor: Yuki Yamagishi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/838,183

(22) Filed: Aug. 27, 2015

(65) Prior Publication Data

US 2016/0060055 A1 Mar. 3, 2016

(30) Foreign Application Priority Data

Aug. 29, 2014 (JP) ..... 2014-175876

(51) Int. Cl.

| | |
|---|---|
| ***B65H 9/04*** | (2006.01) |
| ***B65H 5/06*** | (2006.01) |
| ***B65H 7/08*** | (2006.01) |
| ***B65H 9/00*** | (2006.01) |

(52) U.S. Cl.

CPC ..... *B65H 5/062* (2013.01); *B65H 7/08* (2013.01); *B65H 9/006* (2013.01); *B65H 2301/331* (2013.01); *B65H 2511/11* (2013.01); *B65H 2511/33* (2013.01); *B65H 2513/514* (2013.01); *B65H 2553/22* (2013.01); *B65H 2555/25* (2013.01); *B65H 2555/26* (2013.01)

(58) Field of Classification Search

CPC ..... B65H 9/004; B65H 9/006; B65H 9/106; B65H 9/166

USPC ..... 271/226–228, 242–246

See application file for complete search history.

(56) References Cited

U.S. PATENT DOCUMENTS

2010/0109229 A1* 5/2010 Iwakawa ..... B65H 5/062 271/10.13

2014/0125003 A1* 5/2014 Nozaki ..... B65H 3/0669 271/109

FOREIGN PATENT DOCUMENTS

JP 2013099056 A 5/2013

* cited by examiner

*Primary Examiner* — Thomas Morrison

(74) *Attorney, Agent, or Firm* — Alleman Hall McCoy Russell & Tuttle LLP

(57) ABSTRACT

A sheet conveying device includes a conveying roller, a drive motor, a second detection portion, and a control portion. The control portion includes a first drive control portion, a rotation amount calculation portion, and a second drive control portion. When a front end of a sheet member is detected by the second detection portion, the first drive control portion sets driving of the drive motor in a stopped state before the sheet makes contact with the conveying roller. Rotation amount calculation portion performs a process of calculating a rotation amount of the conveying roller after the sheet member conveyed from upstream in the conveying direction of the sheet member makes contact with the conveying roller. Second drive control portion starts driving of the drive motor at a timing in accordance with the rotation amount of the conveying roller calculated by the rotation amount calculation portion.

6 Claims, 9 Drawing Sheets

FIG. 7A
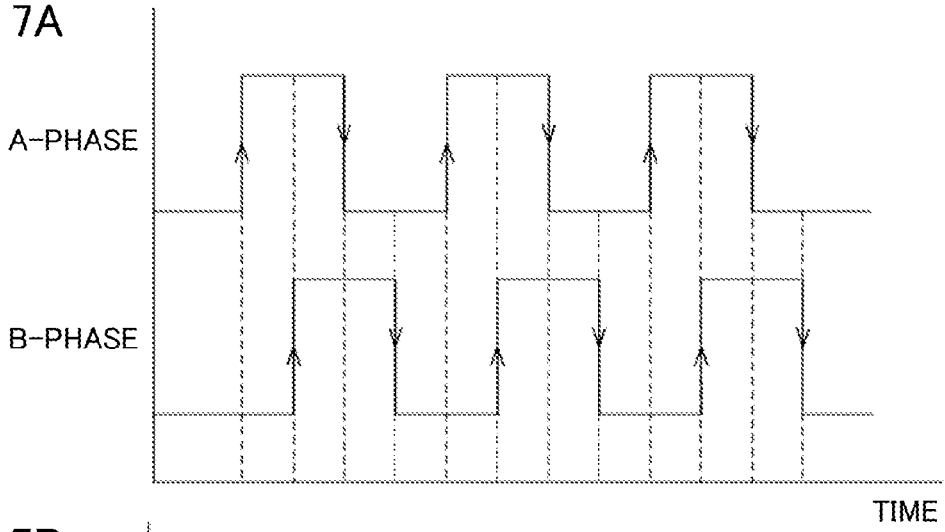
FIG. 7B
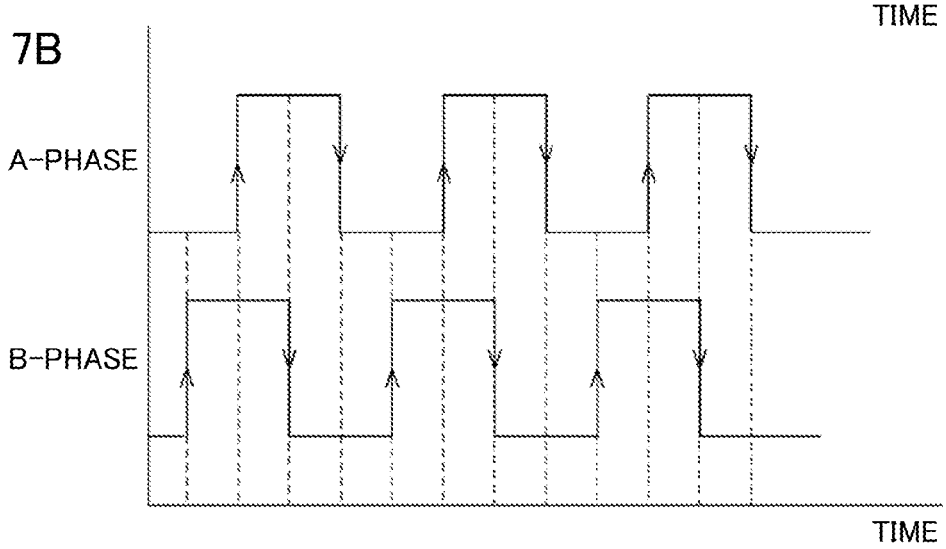
FIG. 7C
| A | B |
|---|---|
| RISING | L |
| H | RISING |
| FALLING | H |
| L | FALLING |
FIG. 7D
| A | B |
|---|---|
| L | RISING |
| RISING | H |
| H | FALLING |
| FALLING | L |

SHEET CONVEYING DEVICE, AND IMAGE FORMING APPARATUS INCLUDING THE SHEET CONVEYING DEVICE

INCORPORATION BY REFERENCE

This application is based upon and claims the benefit of priority from the corresponding Japanese Patent Application No. 2014-175876 filed on Aug. 29, 2014, the entire contents of which are incorporated herein by reference.

BACKGROUND

The present disclosure relates to a sheet conveying device capable of conveying a sheet member, and an image forming apparatus including the sheet conveying device.

An image forming apparatus such as a multifunctional peripheral has a registration roller for performing a registration operation with respect to a sheet member, and an upstream-side conveying roller disposed upstream of the registration roller. The registration operation performed by the upstream-side conveying roller is an operation of applying a conveying force on a sheet member in a conveying direction in a state where a front end of the sheet member is abutted against a nip portion of the registration roller that is being stopped. When the registration operation is performed, skew of the sheet member that is being conveyed is corrected while the sheet member is flexed just in front of the near side of the registration roller. Then, at a timing when a suitable level of flexure is formed, the registration roller is rotationally driven, and the sheet member is conveyed downstream in the conveying direction. In addition, positioning of an image forming position on the sheet member and a transfer position where an image is to be transferred on the sheet member, becomes possible.

A stepping motor is sometimes used as a drive motor (hereinafter, referred to as registration motor) for driving the registration roller. However, the stepping motor needs to be driven with a sufficiently large torque so as to prevent loss of synchronism even when a large load is applied. Since a large torque needs to be generated, the registration motor has a problem regarding having a large power consumption. Thus, as the registration motor, for example, using a servomotor such as a DC brushless motor is conceivable. A technology of using a DC brushless motor as a drive source of a conveying roller for conveying a sheet from a sheet-feed cassette is known.

When the servomotor is to be used as the registration motor, ordinarily, a detector such as a rotary encoder for detecting a rotating state of the registration roller is disposed, and the registration motor is feedback-controlled based on an output signal of the detector.

SUMMARY

A sheet conveying device according to one aspect of the present disclosure includes a conveying roller, a drive motor, a first detection portion, a second detection portion, and a control portion. The conveying roller is configured to convey a sheet member, conveyed from upstream in a conveying direction of the sheet member, toward downstream in the conveying direction of the sheet member. The drive motor is configured to rotationally drive the conveying roller. The first detection portion is configured to detect a rotating state of the drive motor. The second detection portion is configured to detect, at a predetermined position upstream of the conveying roller in the conveying direction of the sheet member, a front end of the sheet member conveyed from upstream in the conveying direction of the sheet member. The control portion is configured to control an operation of the drive motor, and includes a first drive control portion, a rotation amount calculation portion, and a second drive control portion. When the front end is detected by the second detection portion, the first drive control portion is configured to set driving of the drive motor in a stopped state before the sheet makes contact with the conveying roller. The rotation amount calculation portion is configured to perform, based on a detection signal of the first detection portion, a process of calculating a rotation amount of the conveying roller after the sheet member conveyed from upstream in the conveying direction of the sheet member makes contact with the conveying roller. The second drive control portion is configured to start driving of the drive motor at a timing in accordance with the rotation amount of the conveying roller calculated by the rotation amount calculation portion.

The image forming apparatus according to one aspect of the present disclosure includes the sheet conveying device and is configured to form an image on a sheet member conveyed by the conveying roller.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIGS. 7A and 7B show waveforms of pulses in A-phase and B-phase outputted from the rotary encoder. FIGS. 7C and 7D show respective states of signal levels in A-phase and B-phase.

DETAILED DESCRIPTION

Hereinafter, embodiments of the present disclosure will be described with reference to the drawings. It should be noted that the embodiments described below are merely embodied examples of the present disclosure, and can be modified as appropriate within a range not changing the gist of the present disclosure.

[First Embodiment]

Figure 1:
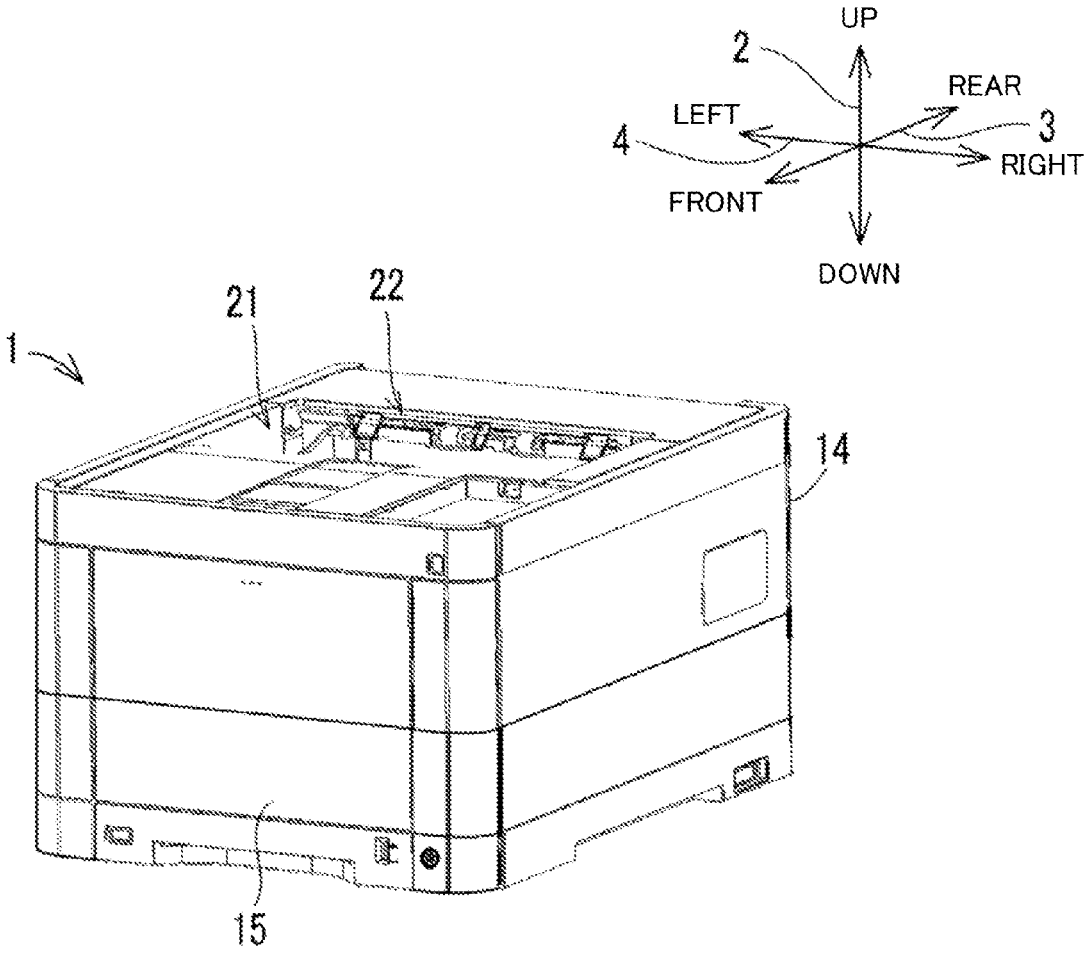
FIG. 1 is a perspective view of an image forming apparatus.
Figure 2A:
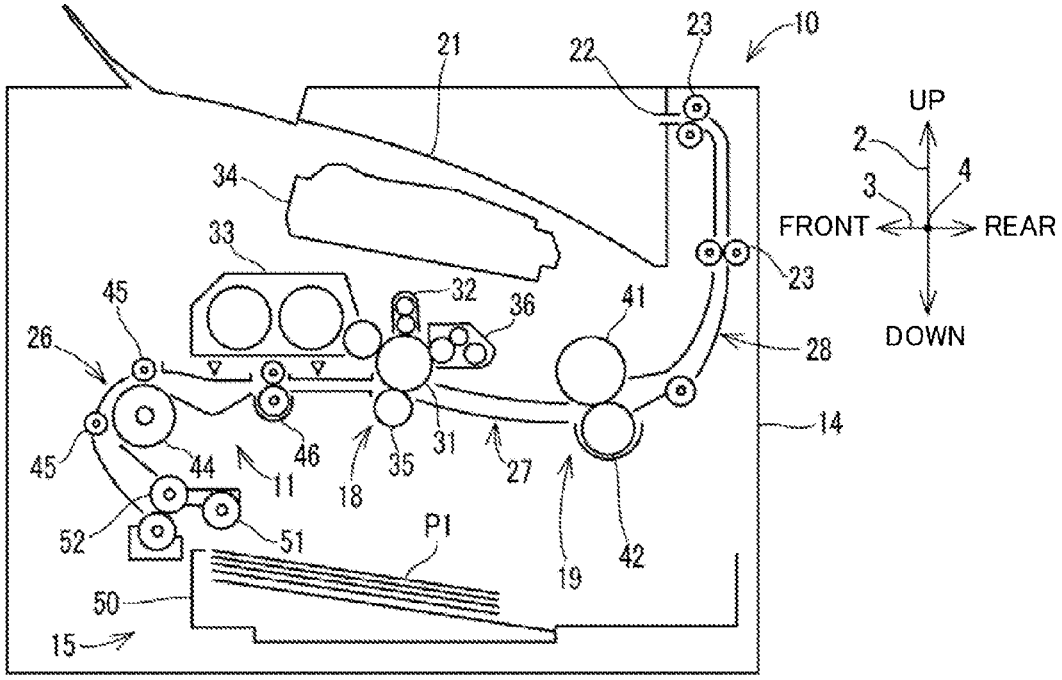
FIG. 2A is a cross sectional view of the image forming apparatus.
Figure 2B:
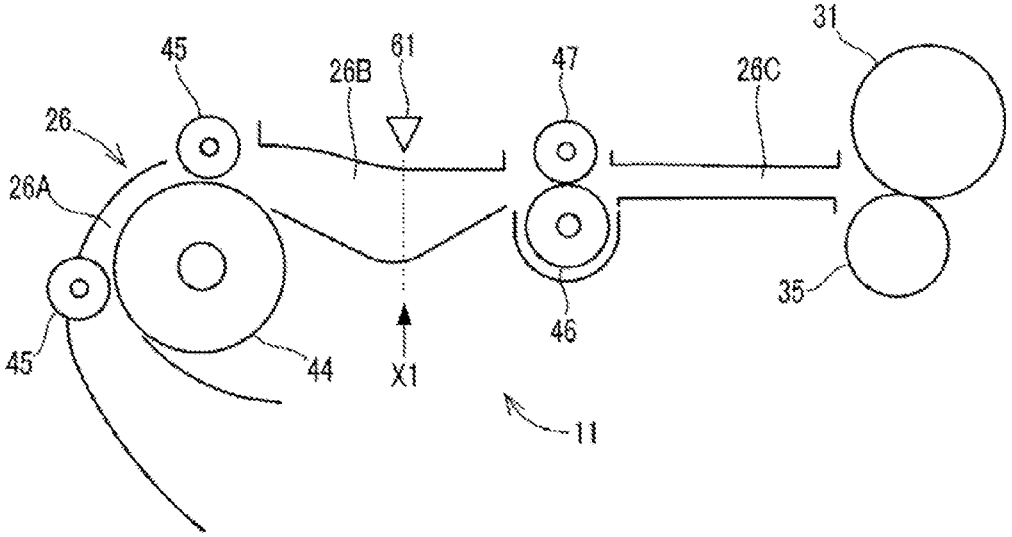
FIG. 2B is a cross sectional view of a sheet conveyance mechanism.

FIGS. 1, 2A, and 2B show a configuration of an image forming apparatus 1 according to a first embodiment of the present disclosure. FIG. 1 is a perspective view of the image forming apparatus 1. FIG. 2 is a cross sectional view of the image forming apparatus 1, FIG. 2A is a schematic cross sectional view of the whole image forming apparatus 1, and FIG. 2B is a detailed cross sectional view of a sheet conveyance mechanism 11. The image forming apparatus 1 is one example of an image forming apparatus of the present disclosure. In the following description, an up-down direction 2 is defined based on a state (state in FIG. 1) in which the image forming apparatus 1 is placed in a usable manner, a front-rear direction 3 is defined when a near side (front side) is regarded as the front, and a right-left direction 4 is defined viewing the image forming apparatus 1 from the near side (front side).

As shown in FIG. 1, the image forming apparatus 1 is a printer configured to print an inputted image on a sheet member P1 using a printing material such as a toner. The image forming apparatus 1 is not limited to a printer that only has a print function. For example, the present disclosure is applicable also to a facsimile, a copy machine, or a multifunctional peripheral combining each of the functions of a printer, a copy machine, and a facsimile, etc.

The image forming apparatus 1 prints an image on a sheet member P1 based on image data inputted from the outside via a network communication portion not shown. As shown in FIGS. 1 and 2A, the image forming apparatus 1 mainly includes an electrophotographic type image forming portion 18, a fixing portion 19, a sheet feeder 15, the sheet conveyance mechanism 11, (one example of a sheet conveying device of the present disclosure), a control portion 90 (see FIG. 3) configured to collectively control the image forming apparatus 1, and a sheet discharge portion 21. These are disposed inside a housing 14 formed of a cover, which is an outer frame, and an inner flame of the image forming apparatus 1.

As shown in FIG. 2A, the sheet feeder 15 is disposed at a bottommost part of the image forming apparatus 1. The sheet feeder 15 includes a sheet-feed tray 50, a pickup roller 51, and a sheet-feed roller pair 52. The sheet-feed tray 50 is configured to house a sheet member P1 on which an image is formed by the image forming portion 18, and is supported by the housing 14. The pickup roller 51 and the sheet-feed roller pair 52 are disposed above a front part of the sheet-feed tray 50. When an instruction to start an operation of feeding a sheet member P1 is inputted to the image forming apparatus 1, the sheet-feed roller pair 52 and the pickup roller 51 are rotationally driven by a conveying motor 56 (see FIG. 3), and the sheet member P1 is fed from the sheet-feed tray 50. The sheet member P1 fed by the pickup roller 51 is conveyed by the sheet-feed roller pair 52 to a first conveying path 26 formed downstream of the sheet-feed roller pair 52 in a feeding direction of the sheet member P1.

The image forming portion 18 is disposed near the end of the first conveying path 26. The image forming portion 18 forms a toner image on the sheet member P1 based on image data inputted from outside. Specifically, the image forming portion 18 transfers a toner image on the sheet member P1 using a toner. As shown in FIG. 2A, the image forming portion 18 includes a photoconductor drum 31 (one example of an image carrier of the present disclosure), a charging portion 32, a developing portion 33, a transfer portion 35, a cleaning portion 36, and an LSU (Laser Scanning Unit) 34 as an exposure portion. When an image formation operation is started, the surface of the photoconductor drum 31 is charged with a uniform potential by the charging portion 32. In addition, laser light in accordance with the image data is scanned from the LSU 34 onto the charged photoconductor drum 31. With this, an electrostatic latent image is formed on the photoconductor drum 31. Then, the toner is adhered to an electrostatic latent image and a toner image is developed on the photoconductor drum 31 by the developing portion 33. The toner image is transferred by the transfer portion 35 to the sheet member P1 conveyed through the first conveying path 26. The sheet member P1, on which the toner image is formed, is conveyed to a second conveying path 27 formed downstream of the image forming portion 18 in the conveying direction of the sheet member P1.

The second conveying path 27 extends toward the back, and, at an end thereof, a fixing portion 19 is disposed. The sheet member P1, sent from the image forming portion 18 out to the second conveying path 27, passes through the second conveying path 27 and is conveyed to the fixing portion 19. The fixing portion 19 fixes a toner image, which has been transferred on the sheet member P1, onto the sheet member P1 using heat and pressure, and includes a heating roller 41 and a pressure roller 42. At the time of a fixing operation, the heating roller 41 is heated to a high temperature by heating means such as an IH heater. When the sheet member P1 passes through the fixing portion 19, a toner is heated and melted by the heating roller 41 of the fixing portion 19, and further pressed by the pressure roller 42. With this, the toner image is fixed on the sheet member P1 to have an image fixed on the sheet member P1. The sheet member P1, on which the image is fixed by the fixing portion 19, is conveyed to a third conveying path 28 formed downstream of the fixing portion 19 in the conveying direction of the sheet member P1.

The third conveying path 28 curves upward from the fixing portion 19, extends straight perpendicularly upward, and further curves in the forward side to reach a sheet outlet 22. Thus, the third conveying path 28 is formed between the fixing portion 19 and the sheet outlet 22. On the third conveying path 28, multiple sheet discharge roller pairs 23 rotated by a conveying motor (not shown) are disposed. The sheet member P1 sent out to the third conveying path 28 is conveyed upward through the third conveying path 28 by the sheet discharge roller pairs 23 rotationally driven by the conveying motor 56, and discharged from the sheet outlet 22 to the sheet discharge portion 21 disposed on an upper surface of the image forming apparatus 1.

Figure 3:
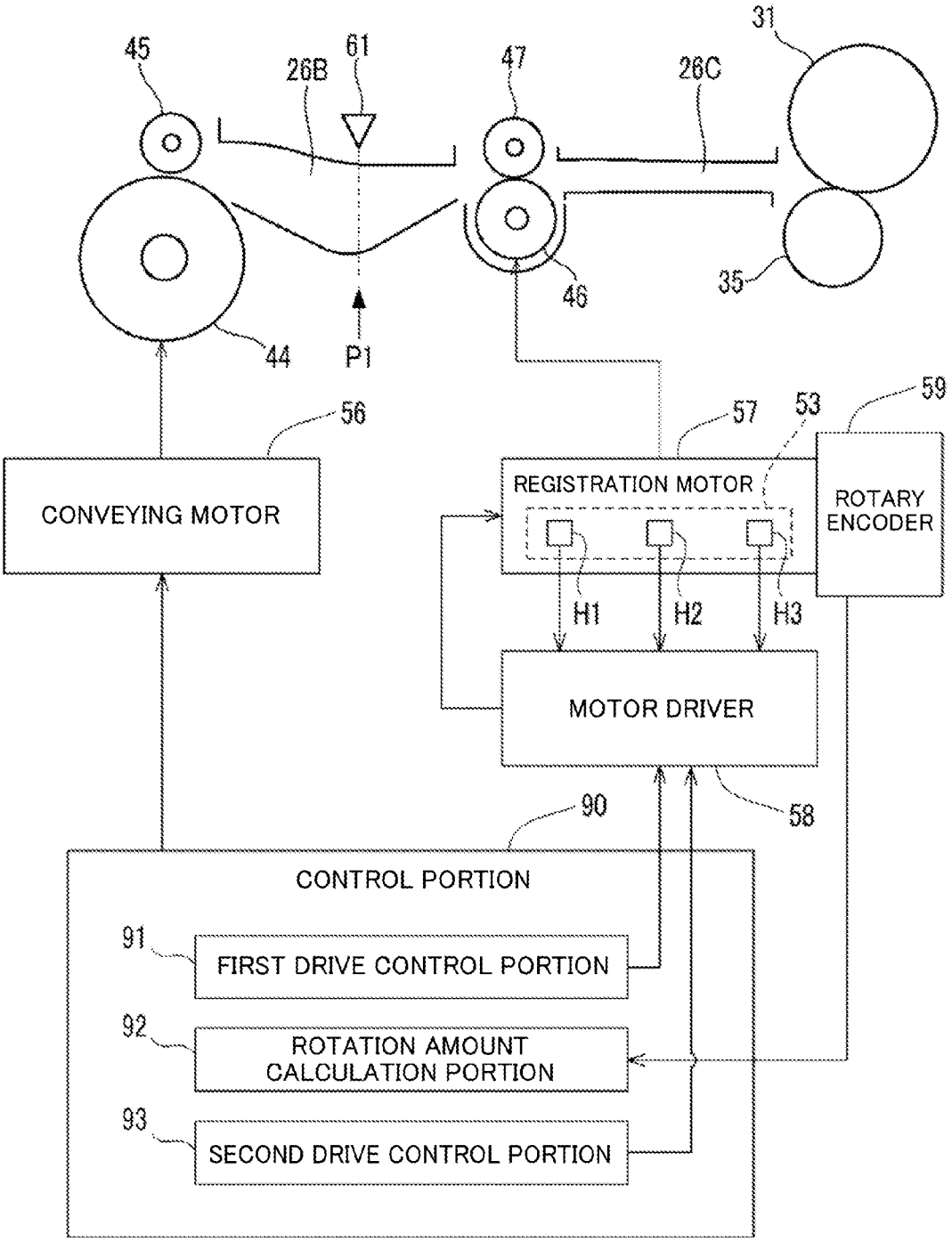
FIG. 3 is a block diagram showing a configuration of the sheet conveyance mechanism.

Next, with reference to FIGS. 2B and 3, a configuration of the sheet conveyance mechanism 11 will be described. As shown in FIG. 2B, the sheet conveyance mechanism 11 is disposed around the first conveying path 26, and mainly includes an upstream-side conveying roller 44, a registration roller 46 (one example of a conveying roller of the present disclosure), and a registration sensor 61 (one example of a second detection portion of the present disclosure). The first conveying path 26 is a conveying path formed between the sheet-feed roller pair 52 and the image forming portion 18, and is formed by conveying guides disposed so as to face each other. The first conveying path 26 includes a curved path 26A that curves upward from the sheet-feed roller pair 52, an intermediate path 26B that extends toward the back from the end of the curved path 26A to reach the registration roller 46, and a straight path 26C extending from the registration roller 46 to reach the image forming portion 18. The upstream-side conveying roller 44 and the registration roller 46 are rotatably disposed such that outer circumferential surfaces thereof are exposed to the first conveying path 26.

The upstream-side conveying roller 44 is rotationally driven when a driving force of the conveying motor 56 (see FIG. 3) is transmitted thereto via a drive transmission mechanism such as a gear that is not shown. As shown in FIG. 2B, the upstream-side conveying roller 44 is arranged inside the curved path 26A. On the outside of the outer circumferential surface of the upstream-side conveying roller 44, two rotary rollers 45 are arranged in contact with the outer circumferential surface of the upstream-side conveying roller 44, and the rotary rollers 45 are also rotated in response to the upstream-side conveying roller 44 being rotationally driven. The sheet member P1 fed to the curved path 26A by the sheet-feed roller pair 52 is conveyed to the intermediate path 26B formed downstream of the upstream-side conveying roller 44 in the conveying direction of the sheet member P1, while being nipped between the upstream-side conveying roller 44 and the rotary rollers 45.

The registration sensor 61 is disposed on the intermediate path 26B. The registration sensor 61 is disposed upstream of the registration roller 46 in the conveying direction of the sheet member P1. The registration sensor 61 is for detecting a front end of the sheet member P1 (an end part located downstream in the conveying direction of the sheet member P1) conveyed from upstream in the conveying direction of the sheet member P1 toward the registration roller 46. The registration sensor 61 is used for determining a timing at which the registration roller 46 is rotationally driven. The registration sensor 61 is, for example, a reflection type phototransistor that can detect the sheet member P1 passing through the intermediate path 26B, or a combination of a probe that is displaced in accordance with passing of the sheet member P1 and a transmission type phototransistor whose optical path is blocked or becomes transmissible in accordance with displacement of the probe.

When the front end of the sheet member P1 reaches a detection position X1 of the registration sensor 61, an output signal of the registration sensor 61 changes from LOW-level to HIGH-level. The registration sensor 61 is connected to the control portion 90, and, when the output signal of the registration sensor 61 changes from LOW-level to HIGH-level, the control portion 90 determines that the front end of the sheet member P1 has reached the detection position X1 of the registration sensor 61.

The registration roller 46, when rotationally driven by a driving force of a registration motor 57 (see FIG. 3), conveys the sheet member P1, which has reached the registration roller 46, toward downstream in the conveying direction of the sheet member P1. The driving force of the registration motor 57 is transmitted to the registration roller 46 via a drive transmission mechanism such as a gear that is not shown. The registration motor 57 is one example of a drive motor of the present disclosure.

The registration roller 46 conveys the sheet member P1 downstream in the conveying direction of the sheet member P1, while adjusting the timing to start conveying the sheet member P1 toward a transfer position where the toner image is transferred by the photoconductor drum 31 disposed at a position downstream of the registration roller 46. The registration roller 46 is disposed between the intermediate path 26B and the straight path 26C. The registration roller 46 is a long roller member that extends straight in a direction orthogonal to the conveying direction. On the outside of the outer circumferential surface of the registration roller 46, a rotary roller 47 is arranged in contact with the outer circumferential surface of the registration roller 46, and the rotary roller 47 is also rotated in response to the registration roller 46 being rotationally driven. The registration roller 46 is used for performing a registration operation with respect to the sheet member P1 conveyed through the intermediate path 26B, and for conveying the sheet member P1 downstream in the conveying direction of the sheet member P1 after the registration operation. Specifically, after the front end of the sheet member P1 is detected by the registration sensor 61, driving force is transmitted to the registration roller 46 that is not in rotation, so that the toner image formed on the photoconductor drum 31 is transferred to a proper position of the sheet member P1. Until the driving force is transmitted, the front end of the sheet member P1 is abutted against a nip portion between the registration roller 46 and the rotary roller 47. When a conveying force is continuously given to the sheet member P1 by the upstream-side conveying roller 44 in this state, the front end of the sheet member P1 becomes aligned in a long side direction of the registration roller 46. With this, skew of the conveyed sheet member P1 is corrected. In this manner, the registration roller 46 corrects the skew of the sheet member P1 , by forming a flexure of the sheet member P1 in cooperation with the upstream-side conveying roller 44 arranged upstream of the registration roller 46, and conveys the sheet member P1 downstream in the conveying direction of the sheet member P1.

The registration motor 57 drives the registration roller 46. Although not diagrammatically represented in detail, in the present embodiment, an inner rotor type direct-current brushless motor having a plurality of electromagnets disposed on a yoke and a rotor disposed inside the yoke is used as the registration motor 57. The rotor and an output shaft 48 (see FIG. 4) are coupled. In the present embodiment, in the registration motor 57, the rotor is rotated when a three-phase drive current having different phases is supplied to the electromagnets. As a result, the registration roller 46 is rotated via the output shaft 48 coupled to the rotor. However, the registration motor 57 is not limited to the direct current brushless motor, as long as the registration motor 57 is a servomotor that is feedback-controlled based on a detection signal of a rotary encoder 59 described later.

Figure 4:
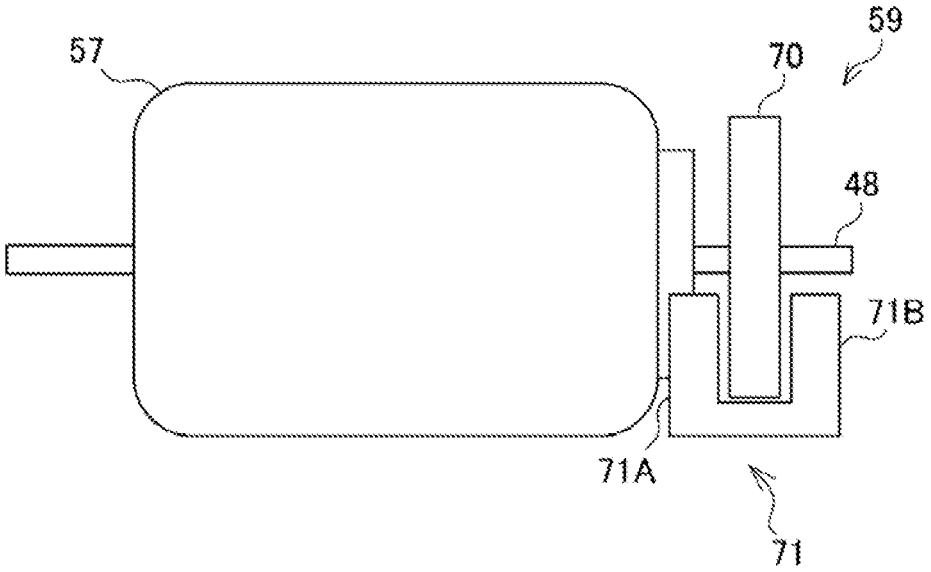
FIG. 4 shows a configuration of a registration motor and a rotary encoder.

Next, the registration motor 57 will be described with reference to FIG. 4. The registration motor 57 has the rotary encoder 59 (hereinafter, simply referred to as an encoder 59) for detecting a rotating state of the registration motor 57. The encoder 59 is one example of a first detection portion of the present disclosure. As shown in FIG. 4, the encoder 59 includes a disk shaped pulse plate 70 and a photo interrupter 71. Along an outer circumference of the pulse plate 70, a large number of slits (not shown) are formed at an interval of, for example, 1° in rotation angle. The pulse plate 70 is fixed on the output shaft 48 of the registration motor 57.

The photo interrupter 71 includes a light emitting portion 71A and a light receiving portion 71B opposing each other with a certain interval therebetween. The pulse plate 70 passes through the gap between the light emitting portion 71A and the light receiving portion 71B. The signal level of signals outputted from the light receiving portion 71B is different between when light outputted from the light emitting portion 71A passes through to one of the slits and is received by the light receiving portion 71B and when light outputted from the light emitting portion 71A is blocked by a part other than the slits of the pulse plate 70. Pulse signals are outputted from the light receiving portion 71B to the control portion 90 when the pulse plate 70 rotates. Thus, when the slits (not shown) are formed along the outer circumference of the pulse plate 70 at an interval of 1° in rotation angle, the encoder 59 can detect the rotating state of the pulse plate 70 at a detection accuracy of 1° in rotation angle.

In the present embodiment, two of the photo interrupters 71 are disposed in the encoder 59, and two pulses having different phases (pulse in A-phase and pulse in B-phase) are outputted from the photo interrupter 71. The pulse in A-phase and the pulse in B-phase are shifted in phase by ¼ cycles. The pulses in two phases are outputted as an output signal of the encoder 59. From the pulses in two phases outputted from the encoder 59, the control portion 90 obtains information regarding the rotating state of the registration motor 57, i.e., rotation amount, rotational speed, and rotation direction of the registration motor 57. In the following description, the rotation direction of the registration roller 46, the pulse plate 70, and the registration motor 57 when the registration roller 46 conveys the sheet member P1 downstream is referred to as a forward rotation direction, whereas the opposite thereof is referred to as a reverse rotation direction.

The registration motor 57 includes a detection portion 53 configured to detect the rotating state of the rotor. The detection portion 53 includes a plurality of Hall-effect sensors. In the present embodiment, the detection portion 53 includes three Hall-effect sensors H1, H2, and H3. The Hall-effect sensors H1, H2, and H3 are arranged apart from each other by an angle interval of 120°. Thus, the detection portion 53 can detect the rotating state of the rotor at a detection accuracy of 120° in rotation angle. Consequently, the detection portion 53 has a lower detection accuracy than the encoder 59. The Hall-effect sensors H1, H2, and H3 are electrically connected to a motor driver 58, and detection signals of the Hall-effect sensors H1, H2, and H3 are outputted to the motor driver 58. The motor driver 58 detects the rotating state of the rotor based on output signals of the Hall-effect sensors H1, H2, and H3. The detection portion 53 is one example of a third detection portion of the present disclosure.

The motor driver 58 is a drive circuit configured to supply the drive current to the electromagnets of the registration motor 57. The motor driver 58 is electrically connected to the control portion 90. The motor driver 58 generates the drive current using PWM method (pulse width modulation method) based on instruction signals from the control portion 90 providing instructions regarding a rotation condition of the registration motor 57, and provides the drive current to the electromagnets of the registration motor 57.

The control portion 90 is formed by, for example, a microcomputer obtained by housing a CPU, a ROM, and a RAM, etc., on a single integrated circuit. The CPU is a processor configured to execute various computation processes. The ROM is a nonvolatile storage portion in which information such as control programs configured to cause the CPU to execute various processes is stored in advance. The RAM is a volatile storage portion and is used as a primary storage memory (workspace) for various processes executed by the CPU. By having the CPU execute a program stored in the ROM, the control portion 90 controls operations of the image forming apparatus 1.

The registration motor 57 in the present embodiment practically does not have any stationary torque, similarly to a stepping motor. Thus, during the registration operation, the registration roller 46 is in a free state of not being retained at a certain position. In this case, during the registration operation and until conveying of the sheet member P1 is started by the registration roller 46 thereafter, the registration roller 46 can unexpectedly rotate in the forward rotation direction or the reverse rotation direction due to some cause. When such a situation occurs, the sheet member P1 may deviate from an appropriate stop position. If conveying of the sheet member P1 by the registration roller 46 is performed without any measures taken against the state in which the sheet member P1 deviates from the appropriate stop position, an image forming position in the sheet member P1 and a transfer position where an image is to be transferred on the sheet member P1 do not match.

Furthermore, if the registration roller 46 unexpectedly rotates as described above, a detection signal is outputted from the encoder 59 regarding the registration roller 46 being rotated, even though the registration motor 57 is in a stopped state in terms of rotation. With this, unintended feedback-control of the registration motor 57 is performed, and, as a result of the feedback-control, the sheet member P1 deviates from the appropriate stop position.

For the purpose of preventing the registration roller 46 from becoming free, an electromagnetic clutch is conceivably disposed on a drive path from the registration motor 57 to the registration roller 46, and the drive path is conceivably blocked or coupled by the electromagnetic clutch. However, having such an electromagnetic clutch leads to enlargement and increase in cost of the device.

In the present embodiment, the following configuration is used in order to appropriately perform a conveying operation of the sheet member P1 by the registration roller 46 when the registration roller 46 is driven by a feedback-controlled servomotor, while preventing enlargement and increase in cost of the device.

The control portion 90 includes a first drive control portion 91, a rotation amount calculation portion 92, and a second drive control portion 93, and controls operations of the registration roller 46 by executing programs using the CPU.

When the front end of the sheet is detected by the registration sensor 61, the first drive control portion 91 sets driving of the registration motor 57 in a stopped state before the sheet member P1 makes contact with the registration roller 46. Here, making contact with the registration roller 46 is synonymous to making contact with the nip portion between the registration roller 46 and the rotary roller 47.

Based on the detection signal of the encoder 59, the rotation amount calculation portion 92 calculates a rotation amount of the registration roller 46 after the sheet member P1 conveyed from upstream makes contact with the registration roller 46.

The second drive control portion 93 starts driving of the registration motor 57 at a timing in accordance with the rotation amount of the registration roller 46 calculated by the rotation amount calculation portion 92.

Figure 5:
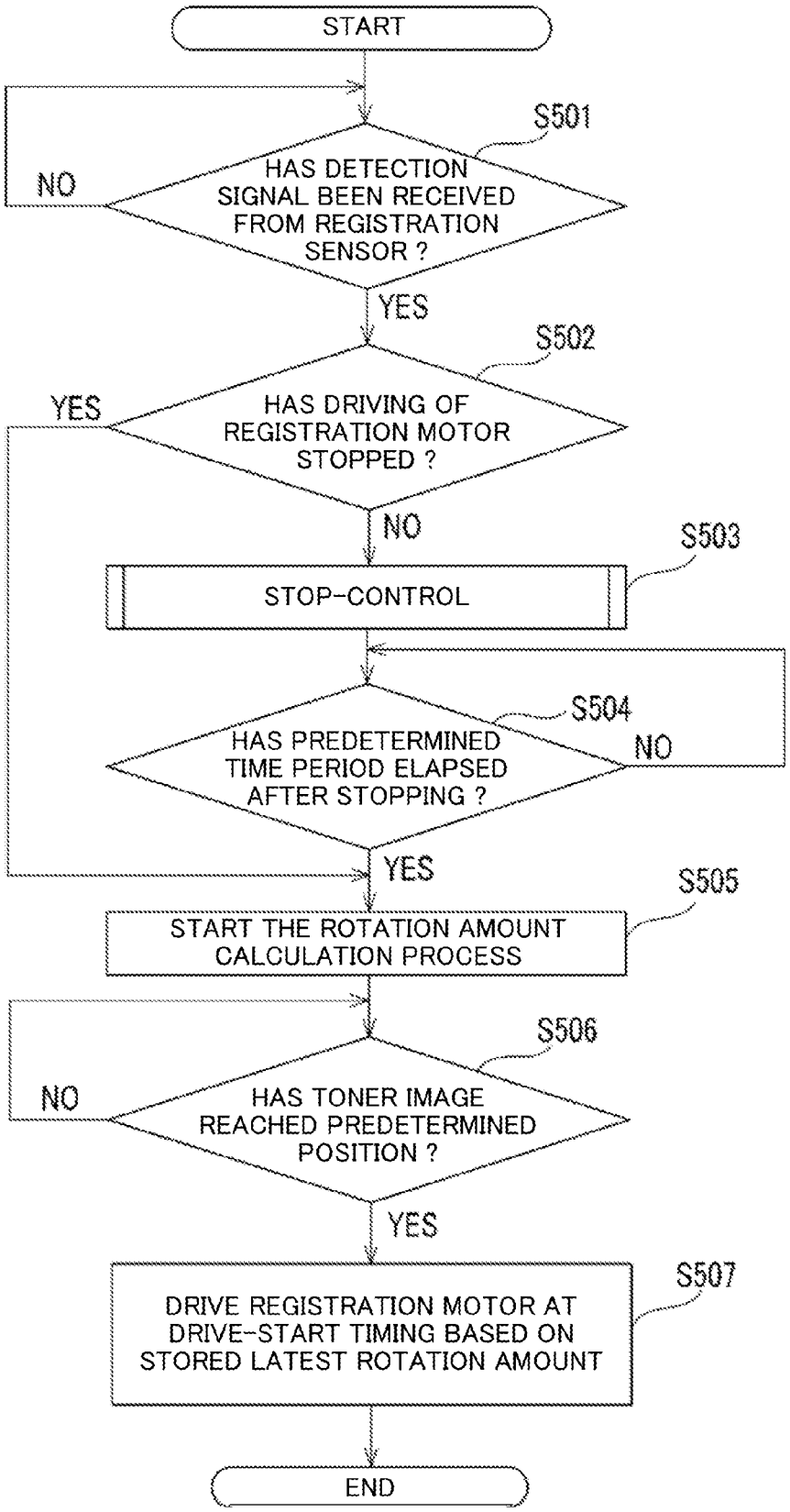
FIG. 5 is a flowchart showing a process of a control portion regarding a registration operation.

Next, by using FIG. 5, specific processes performed by the control portion 90 including the first drive control portion 91, the rotation amount calculation portion 92, and the second drive control portion 93 will be described. In the flowchart of FIG. 5, steps S501, S502 . . . represent processing procedure (step) numbers.

<Step S501>

At step S501, the first drive control portion 91 determines whether or not a detection signal regarding the front end of the sheet member P1 being detected has been received from the registration sensor 61. When the first drive control portion 91 determines that the detection signal has not been received (NO at step S501), the first drive control portion 91 performs the process of step S501 again. When the first drive control portion 91 determines that the detection signal has been received (YES at step S501), the first drive control portion 91 advances the process to step S502.

<Step S502>

At step S502, the first drive control portion 91 determines whether or not driving of the registration motor 57 has already been stopped. When the first drive control portion 91 determines that driving of the registration motor 57 has not been stopped (NO at step S502), the first drive control portion 91 advances the process to step S503. On the other hand, when the first drive control portion 91 determines that driving of the registration motor 57 has already been stopped (YES at step S502), the first drive control portion 91 advances the process to step S505.

<Step S503>

At step S503, the first drive control portion 91 performs stop-control of stopping rotation of the registration motor 57. This stop-control will be described later. Rotation of the registration roller 46 eventually stops as a result of the stop-control. After step S503, the first drive control portion 91 advances the process to step S504.

<Step S504>

At step S504, the first drive control portion 91 determines whether or not a predetermined time has elapsed since driving of the registration motor 57 has been stopped. The predetermined time is time required for stopping the rotation of the registration roller 46 after driving of the registration motor 57 has been stopped. The front end of the sheet member P1 abutts against the registration roller 46 after the rotation of the registration roller 46 has been stopped. At a time thereafter, the control portion 90 stops rotation of the upstream-side conveying roller 44. A predetermined flexure is generated in the sheet member P1 due to a time difference between the time when the rotation of the registration roller 46 is stopped and the time when the rotation of the upstream-side conveying roller 44 is stopped. When the first drive control portion 91 determines that the predetermined time has not elapsed (NO at step S504), the first drive control portion 91 performs the process of step S504 again. On the other hand, when the first drive control portion 91 determines that the predetermined time has elapsed (YES at step S504), the first drive control portion 91 advances the process to step S505.

<Step S505>

At step S505, the rotation amount calculation portion 92 calculates a rotation amount of the registration roller 46 after the rotation of the registration motor 57 has been stopped, based on the detection signal (pulse in A-phase in the present embodiment) outputted from the encoder 59. Then, the rotation amount calculation portion 92 temporarily stores information regarding the rotation amount in the RAM. The rotation amount calculation portion 92 executes these series of rotation amount calculation processes at a predetermined cycle, and updates the information regarding the rotation amount stored in the RAM to be the latest, every time the rotation amount is calculated.

<Step S506>

At step S506, the second drive control portion 93 determines whether or not a toner image formed on the surface of the photoconductor drum 31 has reached a predetermined position. When the second drive control portion 93 determines that the toner image has not reached the predetermined position (NO at step S506), the second drive control portion 93 performs the process of step S506 again. When the second drive control portion 93 determines that the toner image has reached the predetermined position (YES at step S506), the second drive control portion 93 advances the process to step S507.

<Step S507>

At step S507, the second drive control portion 93 starts driving of the registration motor 57 based on the latest information regarding the rotation amount stored in the RAM. More specifically, when the rotation amount calculated by the rotation amount calculation portion 92 is a first rotation amount in the forward rotation direction, the second drive control portion 93 delays, with respect to a drive-start timing of the registration motor 57 set when the calculated rotation amount is zero, the drive-start timing by a time corresponding to the first rotation amount. For example, when the rotation amount calculated by the rotation amount calculation portion 92 is a rotation amount of three pulses in the forward rotation direction, the drive-start timing is delayed by a time corresponding to three pulses with respect to the drive-start timing set when the rotation amount calculated by the rotation amount calculation portion 92 is zero. On the other hand, when the rotation amount calculated by the rotation amount calculation portion 92 is a second rotation amount in the reverse rotation direction, the second drive control portion 93 advances the drive-start timing by a time corresponding to the second rotation amount with respect to the drive-start timing set when the calculated rotation amount is zero. With this, driving of the registration motor 57 can be started at an appropriate timing, even when the registration roller 46 rotates in one of the forward rotation direction and the reverse rotation direction after the sheet member P1 conveyed from upstream in the conveying direction of the sheet member P1 makes contact with the registration roller 46.

Figure 6:
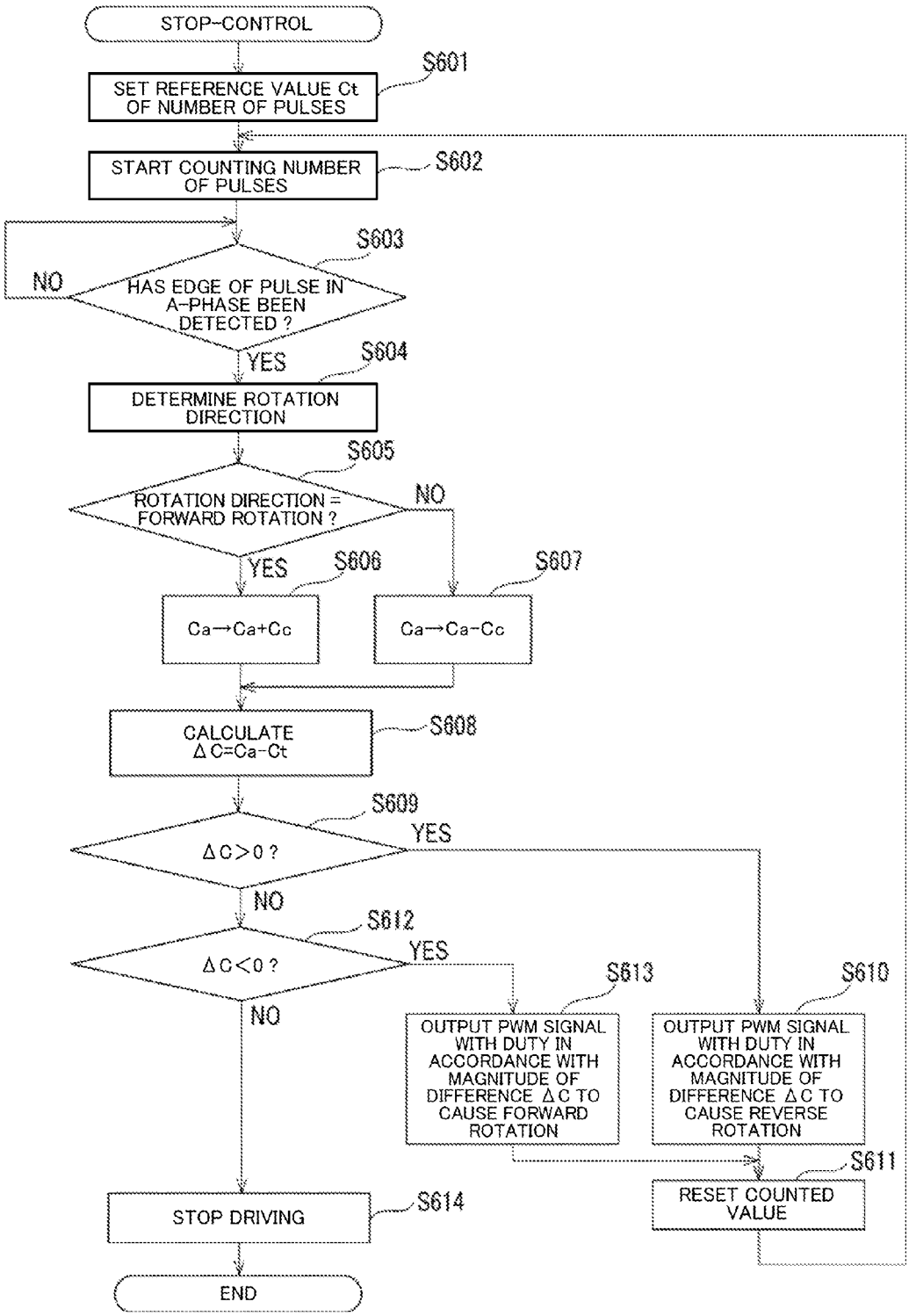
FIG. 6 is a subroutine of stop-control in FIG. 5.

FIG. 6 is a flowchart showing a subroutine of a stop-control process performed by the first drive control portion 91.

In the stop-control process, a process as described next is performed. That is, when performing the stop-control process, the number of pulses required for stopping the rotation of the registration motor 57 is predetermined as, for example, 100, and this number of pulses is set as a reference value Ct. Then, a process of generating and outputting a PWM signal with a duty in accordance with a difference $\Delta C$ between the reference value Ct and an accumulated value Ca of the number of pulses in the forward rotation direction outputted from the encoder 59 is repeated until the accumulated value Ca matches the reference value Ct subsequent to the start of the stop-control process. It should be noted that the number of pulses in the reverse rotation direction is subtracted from the accumulated value Ca. When the accumulated value Ca of the number of pulses in the forward rotation direction outputted from the encoder 59 matches the reference value Ct, the rotation of the registration motor 57 is stopped. The reference value Ct is set such that a time, required for the accumulated value Ca of the number of pulses in the forward rotation direction outputted from the encoder 59 to match the reference value Ct, is shorter than a time required for the front end of the sheet member P1 detected by the registration sensor 61 to make contact with the registration roller 46. Specifically, the processes of steps S601 to S614 are executed.

<Step S601>

At step S601, the first drive control portion 91 sets, as the reference value Ct, the number of pulses required for stopping the rotation of the registration motor 57. Then, the first drive control portion 91 advances the process to step S602.

<Step S602>

At step S602, the first drive control portion 91 starts counting the number of pulses in A-phase, for example. Then, the first drive control portion 91 advances the process to step S603.

<Step S603>

At step S603, the first drive control portion 91 determines whether or not an edge of the pulse in A-phase has been detected. When the first drive control portion 91 determines that the edge has not been detected (NO at step S603), the first drive control portion 91 performs the process of step S603 again. When the first drive control portion 91 determines that the edge has been detected (YES at step S603), the first drive control portion 91 advances the process to step S604.

<Step S604>

At step S604, the first drive control portion 91 determines the rotation direction of the pulse plate 70. More specifically, the first drive control portion 91 determines the rotation direction of the registration motor 57 (rotation direction of the registration roller 46). The rotation direction is calculated based on a relationship between a pulse in A-phase and a pulse in B-phase outputted from the encoder 59. This point will be described in the following.

Patterns shown in FIGS. 7A and 7B are respectively output patterns of the pulse in A-phase and the pulse in B-phase outputted from the encoder 59. More specifically, the output pattern shown in FIG. 7A is a pattern in which the pulse in A-phase is leading the pulse in B-phase by ¼ cycles. On the other hand, the output pattern shown in FIG. 7B is a pattern in which the pulse in B-phase is leading the pulse in A-phase by ¼ cycles.

There are two patterns for the output patterns of pulses in two phases because of the cases where the pulse plate 70 rotates in the forward rotation direction and the reverse rotation direction. Assumed here is a case in which the pulse in A-phase and the pulse in B-phase are outputted from the encoder 59 in the pattern shown in FIG. 7A when the encoder 59 rotates in the forward rotation direction. In this case, when the pulse in A-phase and the pulse in B-phase are outputted from the encoder 59 in the pattern shown in FIG. 7B, this indicates that the encoder 59 is rotating in the reverse rotation direction.

In the case of the output pattern shown in FIG. 7A, the pulse in B-phase is at LOW-level when the pulse in A-phase is rising, as shown in FIG. 7C. In addition, the pulse in A-phase is at HIGH-level when the pulse in B-phase is rising, the pulse in B-phase is at HIGH-level when the pulse in A-phase is falling, and the pulse in A-phase is at LOW-level when the pulse in B-phase is falling.

In the case of the output pattern shown in FIG. 7B, the pulse in B-phase is at HIGH-level when the pulse in A-phase is rising, as shown in FIG. 7D. In addition, the pulse in A-phase is at LOW-level when the pulse in B-phase is rising, the pulse in B-phase is at LOW-level when the pulse in A-phase is falling, and the pulse in A-phase is at HIGH-level when the pulse in B-phase is falling.

Here, regarding the states of the pulses in A-phase and B-phase when either one of the pulses in the two phases is rising or falling, there is no match between the output pattern shown in FIG. 7A and the output pattern shown in FIG. 7B.

For example, in the case with the output pattern shown in FIG. 7A, the pulse in B-phase is at LOW-level when the pulse in A-phase is rising. However, this combination (rising, LOW-level) of the states of the pulses in A-phase and B-phase does not exist in the output pattern shown in FIG. 7B.

By utilizing this point, the first drive control portion 91 determines the rotation direction of the encoder 59. Thus, for the cases of the output pattern shown in FIG. 7A and the output pattern shown in FIG. 7B, information of the states of the pulses in A-phase and B-phase when the pulses in the two phases are rising or falling, as shown in FIGS. 7C and 7D, is stored in the ROM. When the first drive control portion 91 detects rising or falling of either one of the pulses in A-phase and B-phase, the first drive control portion 91 determines the rotation direction of the encoder 59 based on the information in the ROM and the state of the pulses in the two phases upon rising or falling. As a result, the first drive control portion 91 determines the rotation direction of the registration motor 57 and the registration roller 46. For example, in a case where the first drive control portion 91 detects that the pulse in B-phase is at LOW-level when the pulse in A-phase is rising, the first drive control portion 91 determines that the registration motor 57 and the registration roller 46 are rotating in the forward rotation direction.

<Step S605>

At step S605, the first drive control portion 91 determines whether or not the rotation direction of the registration motor 57 and the registration roller 46 is in the forward rotation direction. When the first drive control portion 91 determines that the rotation direction of the registration motor 57, etc., is in the forward rotation direction (YES at step S605), the first drive control portion 91 advances the process to step S606. On the other hand, when the first drive control portion 91 determines that the rotation direction of the registration motor 57 and the registration roller 46 is in the reverse rotation direction (NO at step S605), the first drive control portion 91 advances the process to step S607.

<Step S606>

At step S606, the first drive control portion 91 adds a counted value Cc of the pulse in A-phase of the present time to an accumulated value Ca of the present time. Then, the first drive control portion 91 advances the process to step S608.

<Step S607>

At step S607, the first drive control portion 91 subtracts the present counted value Cc of the pulse in A-phase from the present accumulated value Ca. Then, the first drive control portion 91 advances the process to step S608.

<Step S608>

At step S608, the first drive control portion 91 calculates a difference ΔC (=Ca−Ct) between the accumulated value Ca and the reference value Ct of the present time. After calculating the difference ΔC, the first drive control portion 91 advances the process to step S609.

<Step S609>

At step S609, the first drive control portion 91 determines whether or not the difference ΔC calculated at step S608 is larger than 0, more specifically whether or not the rotation amount of the encoder 59 in the forward rotation direction is larger than the rotation amount corresponding to the reference value Ct. When the first drive control portion 91 determines that the difference ΔC is larger than 0 (YES at step S609), the first drive control portion 91 advances the process to step S610. On the other hand, when the first drive control portion 91 determines that the difference ΔC is not larger than 0 (NO at step S609), the first drive control portion 91 advances the process to step S612.

<Step S610>

At step S610, the first drive control portion 91 outputs a PWM signal with a duty in accordance with the magnitude of the difference ΔC to cause reverse rotation of the registration motor 57. Then, the first drive control portion 91 advances the process to step S611.

<Step S611>

At step S611, the first drive control portion 91 resets the accumulated value Ca of the pulse in A-phase. Then, the first drive control portion 91 returns the process to step S602.

<Step S612>

At step S612, the first drive control portion 91 determines whether or not ΔC is smaller than 0, i.e., whether or not the rotation amount of the encoder 59 in the forward rotation direction is smaller than the rotation amount corresponding to the reference value Ct. When the first drive control portion 91 determines that the difference ΔC is smaller than 0 (YES at step S612), the first drive control portion 91 advances the process to step S613. On the other hand, when the first drive control portion 91 determines that the difference ΔC is not less than 0, i.e., that ΔC=0 is satisfied and the rotation amount of the encoder 59 in the forward rotation direction matches the rotation amount corresponding to the reference value Ct (NO at step S612); the first drive control portion 91 advances the process to step S614.

<Step S613>

At step S613, the first drive control portion 91 outputs a PWM signal with a duty in accordance with the magnitude of the difference ΔC to cause forward rotation of the registration motor 57. Then, the first drive control portion 91 advances the process to step S611.

<Step S614>

At step S614, the first drive control portion 91 stops driving of the registration motor 57 without generating the PWM signal.

As described above, in the present embodiment, the rotation amount of the registration roller 46 after the sheet member P1 conveyed from the upstream-side conveying roller 44 makes contact with the registration roller 46 is calculated based on the detection signal of the encoder 59. Then, at a timing in accordance with the calculated rotation amount of the registration roller 46, driving of the registration motor 57 is started. More specifically, when the rotation amount calculated by the rotation amount calculation portion 92 is the first rotation amount in the forward rotation direction, the drive-start timing of the registration motor 57 is delayed by a time corresponding to the first rotation amount, with respect to when the rotation amount calculated by the rotation amount calculation portion 92 is zero. On the other hand, when the rotation amount calculated by the rotation amount calculation portion 92 is the second rotation amount in the reverse rotation direction, the drive-start timing is advanced by a time corresponding to the second rotation amount with respect to when the rotation amount calculated by the rotation amount calculation portion 92 is zero.

Even when the registration roller 46 unexpectedly rotates due to some cause before conveying of the sheet member P1 by the registration roller 46 is started, conveying of the sheet member P1 by the registration roller 46 downstream in the conveying direction of the sheet member P1 can be started at an appropriate timing.

Since the above described configuration and advantageous effects are achieved by a control without adding a mechanical configuration such as an electromagnetic clutch, the sheet member P1 can be conveyed downstream by the registration roller 46 at an appropriate timing while preventing enlargement and increase in cost of the image forming apparatus 1.

[Second Embodiment]

Next, a second embodiment of the present disclosure will be described.

The rotation of the registration roller 46 after the sheet member P1 makes contact with the registration roller 46 can be restricted or suppressed by supplying a drive current to the registration motor 57 in the reverse rotation direction at a degree where the rotor almost does not rotate. However, when the drive current as described above is continuously supplied to the registration motor 57 in order to maintain the stopped state of rotation of the registration roller 46, a problem as described next sometimes occurs. This point will be described in the following.

The motor driver 58 for supplying the drive current to the registration motor 57 is ordinarily equipped with a lock detection function that performs, when the rotor of the registration motor 57 is locked, a process to detect the locking and stop accepting instructions from the control portion 90, etc. Whether or not locking has occurred is determined based on whether there is no change in the output signal of the detection portion 53 and whether an instruction signal for supplying a predetermined drive current to the registration motor 57 based on the detection signal of the encoder 59 has been outputted from the control portion 90 to the motor driver 58 continuously for a time A or longer. A state in which there is no change in the output signal of the detection portion 53 corresponds to a non-rotating state of the present disclosure.

As described above, when the control portion 90 instructs the motor driver 58 to supply the drive current to the registration motor 57 in the reverse rotation direction at a degree where the rotor almost does not rotate, for the time A or longer, a situation similar to the above described original situation is obtained in which the lock is determined to have occurred. Thus, the motor driver 58 determines that the locking has occurred and stops accepting instructions from the control portion 90.

The lock detection function is a function required when using the registration motor 57. Thus, although the lock detection function cannot be cancelled, it is necessary to avoid a state in which the lock detection function is actuated when the rotor of the registration motor 57 is not locked. The present embodiment is configured in view of this point.

Figure 8:
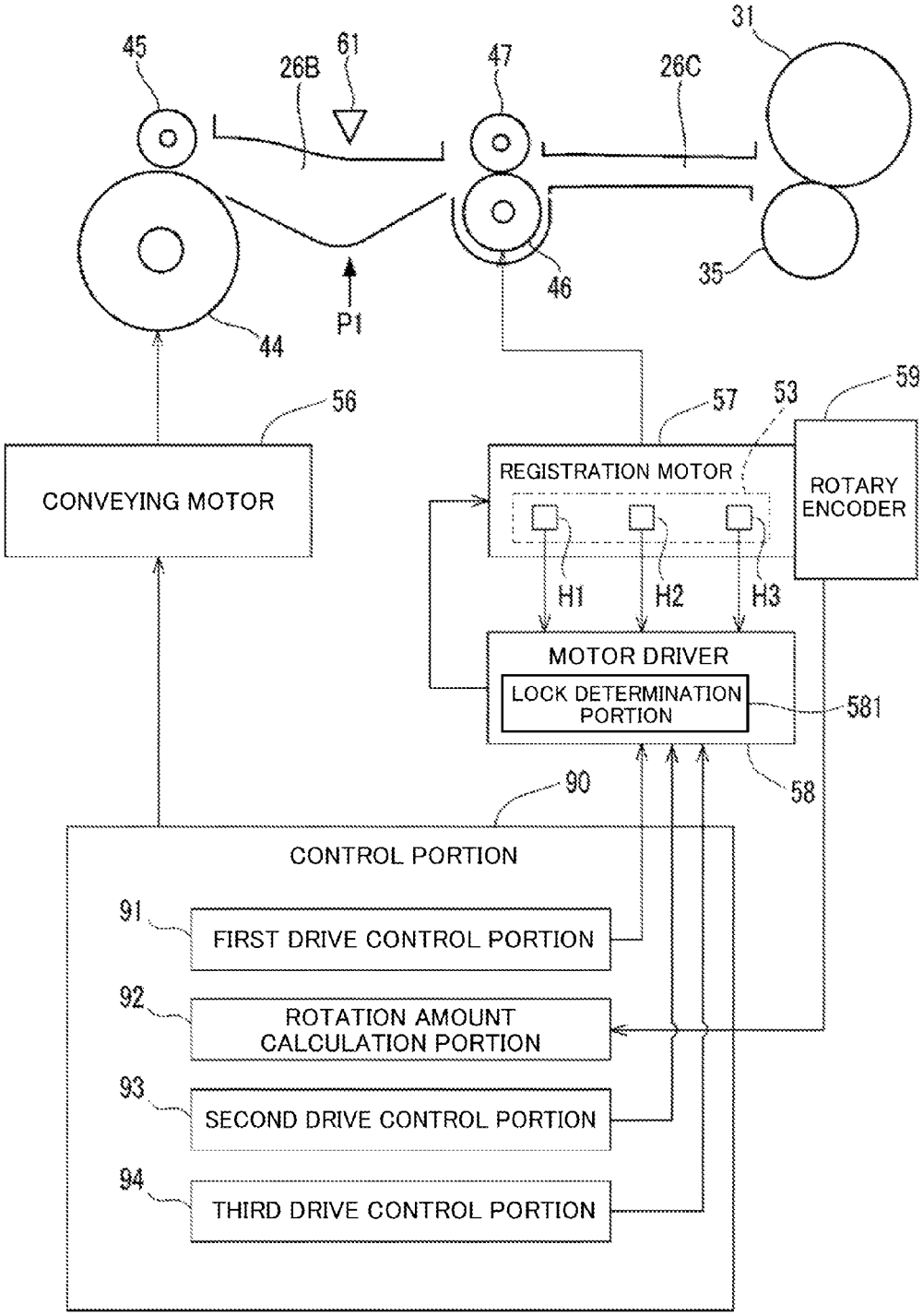
FIG. 8 is a block diagram showing a configuration of a sheet conveyance mechanism according to a second embodiment.

As shown in FIG. 8, in the present embodiment, the motor driver 58 that supplies the drive current to the electromagnets of the registration motor 57 has a lock determination portion 581. The lock determination portion 581 determines that the rotor of the registration motor 57 is locked when there is no change in the output signal of the detection portion 53, and the instruction signal for supplying the predetermined drive current has been outputted from the control portion 90 to the motor driver 58 continuously for the time A or longer. Thus, when a detection value of the encoder 59 and a detection value of the detection portion 53 do not match, the lock determination portion 581 determines that the registration motor 57 is locked. The lock determination portion 581 requires a certain amount of time for determining whether or not the rotor of the registration motor 57 is locked. Hereinafter, this time is referred to as a lock determination time. The lock determination time corresponds to the predetermined time of the present disclosure. The motor driver 58 stops accepting instructions from the control portion 90 when the locking is determined to have occurred by the lock determination portion 581.

The control portion 90 includes a third drive control portion 94 in addition to respective portions 91 to 93 of the first embodiment. The third drive control portion 94 causes, after the front end is detected by the registration sensor 61, reverse rotation of the registration motor 57 at a speed lower than a predetermined rotational speed. When stop-control by the first drive control portion 91 is performed, the third drive control portion 94 causes the registration motor 57 to undergo reverse rotation after the stop-control ends. On the other hand, when the rotation of the registration motor 57 is already stopped when the front end is detected by the registration sensor 61, the third drive control portion 94 causes the registration motor 57 to undergo reverse rotation at a predetermined timing after the front end of the sheet is detected before the sheet abutts against the registration roller 46. The rotational speed of the reverse rotation is an extremely small rotational speed, and is a rotational speed achieved when the rotor is driven by a drive current at a degree where the rotor almost does not rotate.

When a time B, which is shorter than the lock determination time, elapses after the third drive control portion 94 instructs the motor driver 58 to cause reverse rotation of the registration motor 57, the third drive control portion 94 stops the reverse rotation of the registration motor 57.

Figure 9:
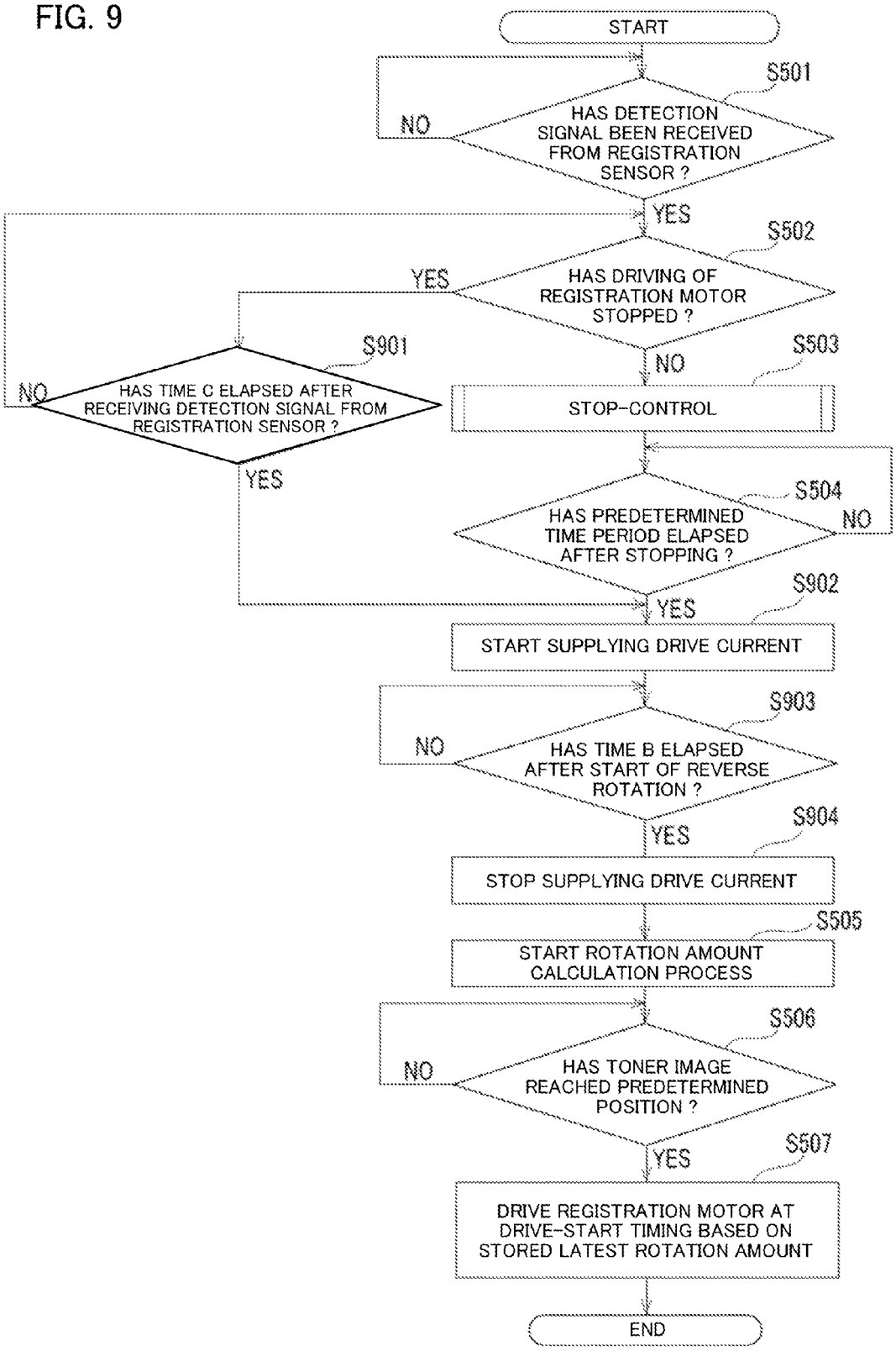
FIG. 9 is a flowchart showing a process of the control portion regarding a registration operation in the second embodiment.

Next, specific processes of the control portion 90 including the third drive control portion 94 will be described using FIG. 9. When compared to the processes shown in FIG. 5, the processes shown in FIG. 9 are different regarding the addition of the processes of steps S901, S902, S903, and S904, and other processes are similar.

<Step S901>

The process at step S901 is performed when the rotation of the registration roller 46 is determined at step S502 by the first drive control portion 91 to already be stopped (YES at step S502). At step S901, the third drive control portion 94 determines whether or not a time C has elapsed after the detection signal regarding the front end of the sheet member P1 being detected has been received from the registration sensor 61 at step S501. When the third drive control portion 94 determines that the time C has not elapsed (NO at step S901), the third drive control portion 94 returns the process to step S502. On the other hand, when the third drive control portion 94 determines that the time C has elapsed (YES at step S901), the third drive control portion 94 advances the process to the process at step S902.

<Step S902>

At step S902, the third drive control portion 94 instructs the motor driver 58 to start supplying the drive current for causing the registration motor 57 to undergo reverse rotation. As described above, the rotational speed of this reverse rotation is an extremely small rotational speed, and is a rotational speed achieved when the rotor is driven by a drive current at a degree where the rotor almost does not rotate.

<Step S903>

At step S903, the third drive control portion 94 determines whether or not the time B has elapsed after the reverse rotation has started at step S902. The time B is a time shorter than the lock determination time. When the third drive control portion 94 determines that the time B has not elapsed (NO at step S903), the third drive control portion 94 performs the process of step S903 again. On the other hand, when the third drive control portion 94 determines that the time B has elapsed (YES at step S903), the third drive control portion 94 advances the process to the process at step S904. During the time B, the sheet member P1 makes contact with the registration roller 46 and a registration process is performed.

<Step S904>

At step S904, the third drive control portion 94 instructs the motor driver 58 to stop supplying the drive current. More specifically, the third drive control portion 94 outputs, to the motor driver 58, an instruction signal to instruct to stop any flow of current with respect to the registration motor 57, before the lock determination time elapses.

Performing such a process is effective in terms of the point described next. Generally, the time required for generating the flexure in the sheet after the sheet is abutted against the registration roller 46 is shorter than the lock determination time. Thus, by simply driving the registration roller 46 in the reverse rotation direction until the motor driver 58 determines that locking has occurred, the registration roller 46 can be suppressed from rotating largely by a relatively large force that acts upon the registration roller 46 during the flexure forming process.

Then, the registration roller 46 can be suppressed from rotating largely while avoiding a state in which a determination is made that the rotor of the registration motor 57 is locked even when locking has not occurred.

The situation in which it is incorrectly determined that locking has occurred is not limited to the case where the drive current is supplied to the registration motor 57 in the reverse rotation direction at a degree where the rotor almost does not rotate for the purpose of restricting or suppressing the rotation of the registration roller 46 in the forward rotation direction.

When the process of causing the registration motor 57 to undergo reverse rotation as described above is not performed, the registration roller 46 enters a free state of not being retained at a certain position during the registration operation. In this case, the pulse plate 70 may oscillate in the forward and reverse rotation directions due to some cause.

When the pulse plate 70 oscillates with a relatively short cycle, an edge of the slits may move back and forth in a detection area of the photo interrupter 71 in the forward and reverse rotation directions of the pulse plate 70 at a relatively short cycle. At this moment, since the detection signal is outputted from the photo interrupter 71, the control portion 90 that received the detection signal incorrectly determines that the registration motor 57 is rotating in the forward rotation direction or the reverse rotation direction. Because of this incorrect determination, the control portion 90 incorrectly gives an instruction to the motor driver 58 to supply the predetermined drive current. Also in this case, a situation of incorrectly determining that locking has occurred can take place.

Thus, also in this case, by performing each of the processes in the flowchart shown in FIG. 9, it is possible to avoid a determination of locking being occurred, due to oscillation of the pulse plate 70 at a relatively short cycle.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a conveying roller configured to convey a sheet member, conveyed from upstream in a conveying direction of the sheet member, toward downstream in the conveying direction of the sheet member;

a drive motor configured to rotationally drive the conveying roller;

a first detection portion configured to detect a rotating state of the drive motor;

a second detection portion configured to detect, at a predetermined position upstream of the conveying roller in the conveying direction of the sheet member, a front end of the sheet member conveyed from upstream in the conveying direction of the sheet member;

a third detection portion configured to detect the rotating state of the drive motor at a lower detection accuracy than the first detection portion;

a lock determination portion configured to perform a process of determining that the drive motor is locked when a detection value of the first detection portion and a detection value of the third detection portion do not match; and a control portion configured to control an operation of the drive motor, the control portion including:

a first drive control portion configured to, when the front end is detected by the second detection portion, set driving of the drive motor in a stopped state before the sheet member makes contact with the conveying roller;

a rotation amount calculation portion configured to perform, based on a detection signal of the first detection portion, a process of calculating a rotation amount of the conveying roller after the sheet member conveyed from upstream in the conveying direction of the sheet member makes contact with the conveying roller; and a second drive control portion configured to start driving of the drive motor at a timing in accordance with the rotation amount of the conveying roller calculated by the rotation amount calculation portion; and a third drive control portion configured to, after the front end is detected by the second detection portion, rotate the drive motor in a reverse direction that is a rotation direction for conveying the sheet member upstream in the conveying direction of the sheet member at a speed lower than a predetermined rotational speed, wherein the third drive control portion stops the reverse rotation of the drive motor before elapsing of a lock determination time required by the lock determination portion for determining that the drive motor is locked.

2. The sheet conveying device according to claim 1, wherein:

when the rotation amount calculated by the rotation amount calculation portion is a first rotation amount in a forward rotation direction for conveying the sheet member downstream in the conveying direction of the sheet member, the second drive control portion delays a drive-start timing of the drive motor by a time corresponding to the first rotation amount, with respect to when the rotation amount calculated by the rotation amount calculation portion is zero; and when the rotation amount calculated by the rotation amount calculation portion is a second rotation amount in a reverse rotation direction for conveying the sheet member upstream in the conveying direction of the sheet member, the second drive control portion advances the drive-start timing by a time corresponding to the second rotation amount, with respect to when the rotation amount calculated by the rotation amount calculation portion is zero.

3. The sheet conveying device according to claim 1, wherein the third detection portion includes a plurality of Hall-effect sensors configured to detect rotation of the drive motor, the lock determination portion is disposed on a motor driver configured to generate a drive current for driving the drive motor, the control portion is formed of an integrated circuit configured to control operation of the drive motor by outputting, to the motor driver, instruction signals instructing a rotation condition of the drive motor, the lock determination portion is configured to determine that the drive motor is locked, when a detection signal indicating a non-rotating state of the drive motor is outputted from the third detection portion and a state of receiving an instruction signal regarding rotating the drive motor at a predetermined rotation condition calculated by the control portion based on a detection signal of the first detection portion has continued for a predetermined time, and the control portion is configured to output, to the motor driver, an instruction signal to instruct to stop any flow of current with respect to drive motor, before the lock determination time elapses.

4. The sheet conveying device according to claim 1, wherein the drive motor is a servomotor that is feedback-controlled based on a detection signal of the first detection portion.

5. The sheet conveying device according to claim 1, wherein the conveying roller is a registration roller configured to convey the sheet member downstream in the conveying direction of the sheet member, after skew of the sheet member is corrected by forming a flexure in the sheet member in cooperation with an upstream-side conveying roller arranged upstream in the conveying direction of the sheet member.

6. An image forming apparatus comprising the sheet conveying device according to claim 1, configured to form an image on a sheet member conveyed by the conveying roller.

* * * * *